US009696042B2

(12) United States Patent
Hasslberger et al.

(10) Patent No.: US 9,696,042 B2
(45) Date of Patent: Jul. 4, 2017

(54) VENTILATION PANEL AND OVEN

(75) Inventors: Robert Hasslberger, Ruhpolding (DE); Dan Neumayer, Bernau (DE); Jörg Rosenbauer, Nuβdorf (DE); Markus Theine, Freilassing (DE)

(73) Assignee: BSH Hausgeräte GmbH, Munich (DE)

( * ) Notice: Subject to any disclaimer, the term of this patent is extended or adjusted under 35 U.S.C. 154(b) by 2869 days.

(21) Appl. No.: 12/012,728

(22) Filed: Feb. 4, 2008

(65) Prior Publication Data

US 2008/0184985 A1 Aug. 7, 2008

(30) Foreign Application Priority Data

Feb. 5, 2007 (DE) ..... 10 2007 005 718

(51) Int. Cl.
*F24C 15/32* (2006.01)
*F24C 15/00* (2006.01)

(52) U.S. Cl.
CPC ..... *F24C 15/006* (2013.01)

(58) Field of Classification Search
USPC ..... 126/21 R, 273 R, 273 A, 198, 273 H, 126/190–194, 197; 219/385, 390, 391,
(Continued)

(56) References Cited

U.S. PATENT DOCUMENTS 2,526,890 A * 10/1950 Mendel ..... 126/39 C
2,539,150 A * 1/1951 Mills ..... 49/483.1
(Continued)

FOREIGN PATENT DOCUMENTS

DE 31 04 677 8/1982
EP 0 520 635 12/1992
(Continued)

OTHER PUBLICATIONS

National Search Report DE 10 2007 005 718.2.

*Primary Examiner* — Jorge Pereiro
(74) *Attorney, Agent, or Firm* — Michael E. Tschupp; Andre Pallapies

(57) ABSTRACT

A ventilation panel for a ventilation system of an oven with an air inlet aperture has a first subsidiary air inlet aperture and a second subsidiary air inlet aperture, which are separated from each other by a dividing wall at least partially in the air entry area. The oven has a housing ventilation duct, which directs air at least partially around a muffle, where the housing ventilation duct is at least partially divided into a first and a second subsidiary ventilation duct, where entry of the air to the subsidiary ventilation ducts takes place by means of a shared ventilation panel, and a door ventilation duct, which directs air through an oven door, where a fresh air feed leads to the ventilation panel, and where, when the oven door is closed, an air outlet aperture of the door ventilation duct of the ventilation panel of the housing ventilation duct lies opposite to and at a distance from an area of the second subsidiary ventilation duct, the ventilation panel having a first subsidiary air inlet aperture, which is allocated to the first subsidiary ventilation duct, and a second subsidiary air inlet aperture, which is allocated to the second subsidiary ventilation duct, where the subsidiary air inlet apertures are at least partially separated from each other by means of a dividing wall in the air entry area.

24 Claims, 4 Drawing Sheets

(58) Field of Classification Search
USPC ..... 219/399, 400, 757, 756, 632
See application file for complete search history.

(56) References Cited

U.S. PATENT DOCUMENTS

| | | | | | |
|---|---|---|---|---|---|
| 3,233,606 | A | * | 2/1966 | Robert et al. | 126/299 D |
| 3,384,067 | A | * | 5/1968 | Rawald et al. | 126/21 A |
| 3,499,430 | A | * | 3/1970 | Kemp | 126/21 R |
| 3,659,579 | A | * | 5/1972 | Henderson et al. | 126/21 A |
| 3,779,228 | A | * | 12/1973 | Mizuno et al. | 126/21 R |
| 3,783,219 | A | * | 1/1974 | Tateda | 219/757 |
| 4,331,124 | A | * | 5/1982 | Seidel et al. | 126/21 A |
| 4,375,213 | A | * | 3/1983 | Kemp et al. | 126/21 A |
| 4,592,333 | A | * | 6/1986 | Dustin | 126/21 R |
| 4,763,638 | A | * | 8/1988 | Hurley et al. | 126/21 A |
| 4,796,600 | A | | 1/1989 | Hurley et al. | |
| 5,107,821 | A | * | 4/1992 | von Blanquet | 126/19 R |
| 5,387,258 | A | * | 2/1995 | Puricelli | 126/21 A |
| 5,474,055 | A | * | 12/1995 | Kang | 126/39 R |
| 5,738,081 | A | * | 4/1998 | Puricelli | 126/21 A |
| 7,547,862 | B2 | * | 6/2009 | Kim et al. | 219/400 |
| 7,874,289 | B2 | * | 1/2011 | Larsen | 126/198 |
| 7,923,663 | B2 | * | 4/2011 | Kim et al. | 219/391 |
| 2005/0224490 | A1 | * | 10/2005 | Austin et al. | 219/408 |
| 2006/0219234 | A1 | * | 10/2006 | Larsen | 126/198 |
| 2007/0158328 | A1 | * | 7/2007 | Kim et al. | 219/391 |

FOREIGN PATENT DOCUMENTS

| | | | | |
|---|---|---|---|---|
| EP | 0520635 | A1 | * | 12/1992 |
| FR | 2726633 | A1 | * | 5/1996 |
| GB | 2256921 | A | * | 12/1992 |
| WO | WO 2006/064457 | | | 6/2006 |

* cited by examiner

VENTILATION PANEL AND OVEN

The invention relates to a panel for a ventilation system of an oven with a housing ventilation duct, which at least partially directs air around an oven muffle, with the housing ventilation duct being at least partially divided into a first and a second subsidiary ventilation duct, with the entry of air to said subsidiary ventilation ducts taking place by means of a shared ventilation panel and a door ventilation duct, which at least partially directs air through an oven door, where a fresh air feed leads to the ventilation panel and where, when the oven door is closed, an air outlet aperture of the door ventilation duct of the housing ventilation duct's ventilation panel lies opposite to and at a distance from an area of the second subsidiary ventilation duct.

It is a disadvantageous characteristic of known ovens that it has to date not been possible for air to be sucked out of the door ventilation duct into the ventilation panel in a cost-efficient manner and with sufficient power.

The object of the invention is thus to provide a possibility for the cost-efficient and effective setting-up of air currents through an oven of the abovementioned type.

This object is achieved by means of a ventilation panel as claimed in claim 1 and an oven as claimed in claim 2. Advantageous embodiments can be taken in particular from the subclaims.

To this end the ventilation panel has a first subsidiary air inlet aperture and a second subsidiary air inlet aperture, which are separated from each other at least partially in the air entry area by a dividing wall. The entry of a quantity of fresh air through the first and the second air inlet aperture can be controlled by means of the dividing wall, via which suction strengths can be set. A suction power level between the door ventilation duct and the associated subsidiary air inlet aperture can thereby be set, in particular cost-efficiently, by adjusting the fresh air mixture.

The object is also achieved by the oven, in that the ventilation panel has a first air inlet aperture which is assigned to the first subsidiary ventilation duct, and a second air inlet aperture which is assigned to the second subsidiary ventilation duct, where the subsidiary air inlet apertures are separated from each other by a dividing wall at least partially in the air entry area.

Here, a gap through the dividing wall for the passage of fresh air to the second subsidiary ventilation duct can be created between said dividing wall and another part of the oven, for example a door housing. By means of the gap width it is possible to set the suction power level to the door ventilation duct (a narrower gap results in a higher suction level) and achieve cooling of the warm air sucked out of the door ventilation duct, which is adjustable via the fresh air feed.

Typically, the oven has a fan, in particular a radial-flow fan, for suction and expelling of the air.

For optimum control of the air currents or suction levels, the dividing wall preferably divides the air inlet apertures across their entire width.

For the purposes of cost-effective manufacture, it is advantageous if the dividing wall is a projection built in, in particular impressed, into the ventilation panel.

In order to create the suction power in the first ventilation duct it is advantageous if the projection is cross-sectionally chamfered in the form of a ramp on a side facing the first subsidiary air inlet aperture, and/or the neck of the projection is arranged in close proximity to the first subsidiary air inlet aperture. Air can thereby be conveyed directly into the first subsidiary air inlet aperture, in particular with reduction of the cross section of the flow.

In the case of a closed oven door, a defined gap between the oven door and the second subsidiary air inlet aperture is preferably created by the shape and/or position of the dividing wall.

For the effective cooling of heat-sensitive components, it is advantageous if the second subsidiary air duct runs along a wall of the muffle, and the first subsidiary air duct is separated from the muffle and accommodates electrical and/or electronic components.

The ventilation panel and an oven equipped therewith are represented diagrammatically in greater detail below, on the basis of an exemplary embodiment. This exemplary embodiment is not intended to limit the invention. In the exemplary embodiments, functionally identical parts are identified using the same reference numbers and air flows are indicated by straight arrows, where:

Figure 1:
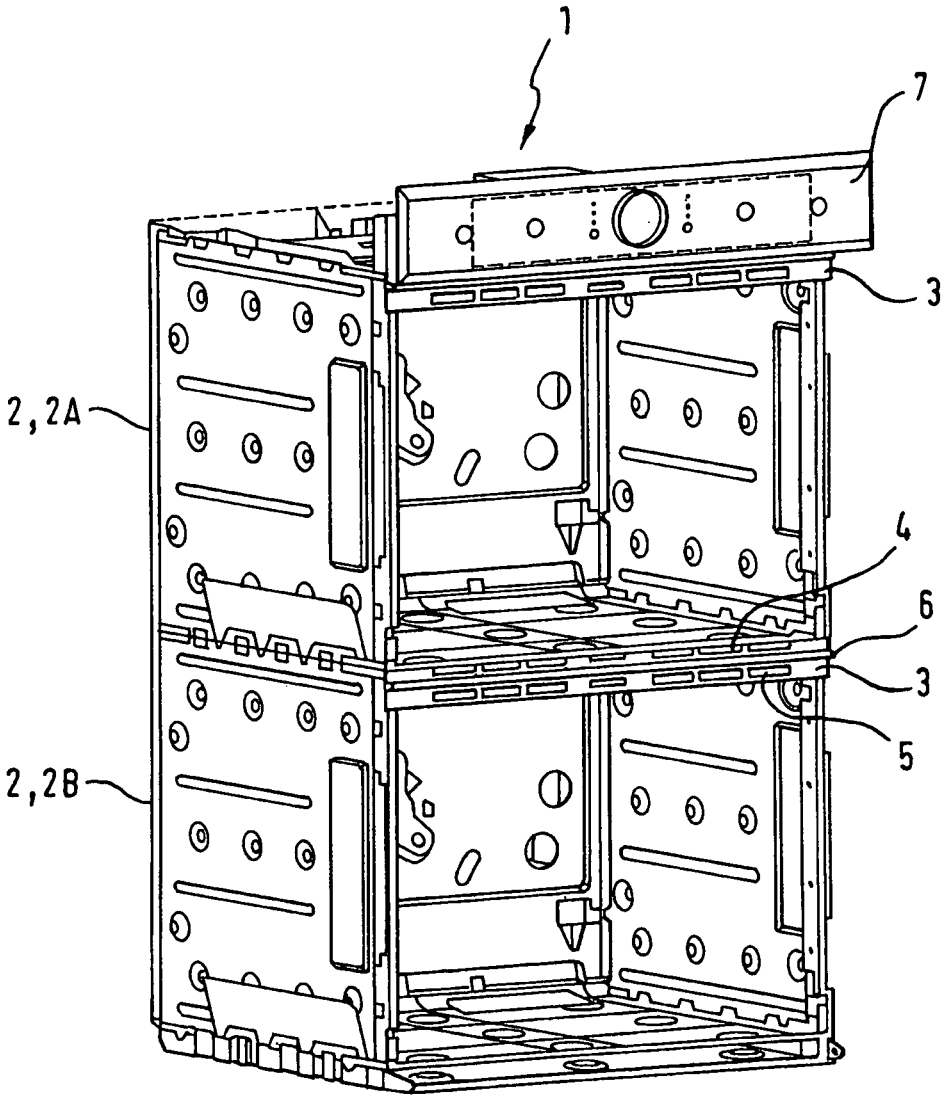
FIG. 1 shows an oblique view of a housing of a double oven.

FIG. 1 shows a housing 2 of a double oven 1 with an upper housing enclosure 2A and a lower housing enclosure 2B. Muffles are in each case set frontally into the enclosures 2A and 2B respectively. A ventilation panel 3 which has a first subsidiary air inlet aperture 4 in the form of a first set of air inlet slots and a second subsidiary air inlet aperture 5 in the form of a second set of air inlet slots is mounted frontally in the upper region of each housing enclosure 2A, 2B. The subsidiary air inlet apertures 4, 5 are divided from each other across their entire width by a dividing wall 6 in the form of a projection protruding outwards. A switch panel 7 is mounted above the upper housing enclosure 2A.

Figure 2:
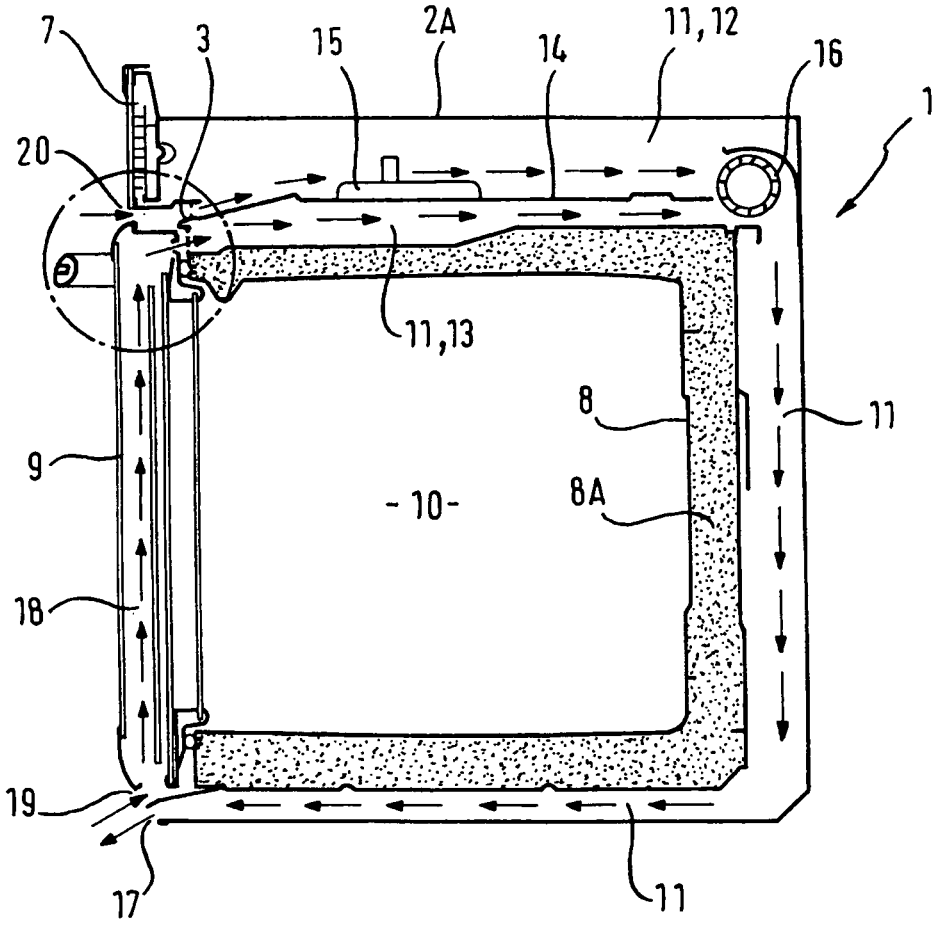
FIG. 2 shows a cross-sectional view of an oven of the double oven shown in FIG. 1, with a built-in muffle and oven door.

FIG. 2 shows a cross section through an oven arranged in the upper housing enclosure 2A, with a closed oven door.

Set into the housing enclosure 2A is an oven muffle 8 which can be closed by means of an oven door 9 and has insulation 8A between it and the housing 2A. A cooking compartment 10 is defined by the oven muffle 8 and the oven door 9 which enclose it. The oven further has a housing ventilation duct 11 which here directs air in a clockwise direction, as indicated by arrows, around the muffle between said muffle 8 and the housing 2A.

At the top of the muffle, the housing ventilation duct 11 is divided into a first, upper subsidiary ventilation duct 12, and a second, lower subsidiary ventilation duct 13. The entry of air to the subsidiary ventilation ducts 12, 13 takes place by means of the shared ventilation panel 3. The subsidiary ventilation ducts 12, 13 are separated from each other by a carrier plate 14 on which are mounted, in the first, upper subsidiary ventilation duct 12, heat-sensitive electrical and/or electrical components 15, for example control electronics, a safety circuit and the like. For this reason the first subsidiary ventilation duct 12 is separated from the muffle by the second subsidiary ventilation duct 13, thus achieving insulation of the components 15 from the heat from the muffle 8. The second subsidiary ventilation duct 13, on the other hand, runs along the muffle 8, mainly absorbing the heat radiated by the muffle 8 in this area. The subsidiary ventilation ducts 12, 13 converge once again at the rear edge of the housing 2A in the air suction area of a radial-flow fan 16, to which are linked, downstream, a rear and a lower area of the housing ventilation duct 11 extending as far as an exhaust vent 17.

The oven door 9 has a door ventilation duct 18 running vertically across a significant portion of the door width, which directs air through the oven door from an oven door air inlet aperture 19 arranged in the lower area of the oven door 9 upwards to an oven door air outlet aperture in the door cover.

Air emerges through the ventilation panel 3 into the housing ventilation duct 11 from a fresh air duct 20 formed by the switch panel 7 and the oven door 9, as well as from the second oven door air outlet aperture essentially opening toward the subsidiary air inlet aperture 5.

Figure 3:
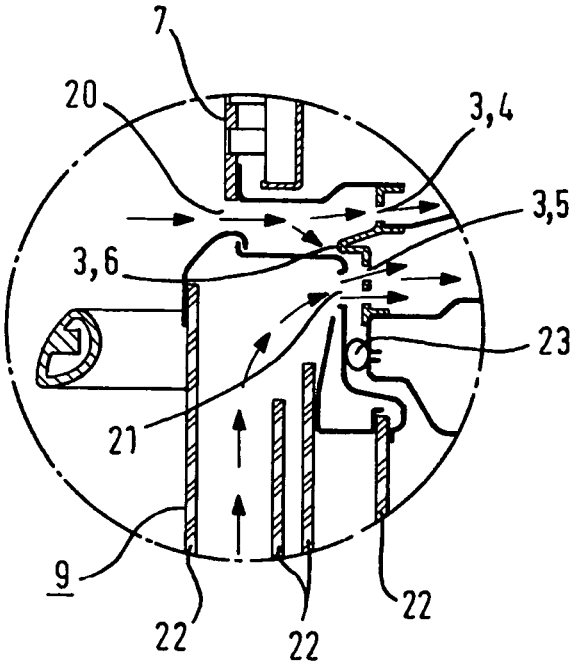
FIG. 3 shows a segment of the oven from FIG. 2 in the area of the ventilation panel.

FIG. 3 now shows the area around the ventilation panel 3 in greater detail. As described in greater detail below, the first, upper subsidiary air inlet aperture 4 is largely divided externally, in flow-related terms, from the second, lower subsidiary air inlet aperture 5, except for a defined gap by means of the projection 6.

Fresh air is sucked out of the fresh air duct 20 formed by the switch strip 7 and the oven door 9 into the first, upper subsidiary air inlet aperture 4. As, with its upper side facing the first subsidiary air inlet aperture 4, the projection is cross-sectionally chamfered in the form of a ramp, specifically rising in an area close to the first air inlet aperture 4, fresh air can simply be sucked into the first, upper subsidiary ventilation duct 12.

Air is also sucked from the oven door 9 through the oven door air outlet aperture 21 via a narrow space between the oven door 9 or the oven door air outlet aperture 21 and the ventilation panel 3 or the second, lower subsidiary air inlet aperture 5 through the second, lower subsidiary air inlet aperture 5, which is located at around the same height, into the second, lower subsidiary air inlet aperture 13. The air sucked out of the door 9 serves in particular to cool glass panes 22 of the door 9. A seal 23 prevents an exchange of air and cooking fumes. Between the projection 6 and the oven door 9 is a gap through which fresh air sucked out of the fresh air duct 20 can be sucked in a defined manner into the second subsidiary ventilation duct 13.

Figure 4:
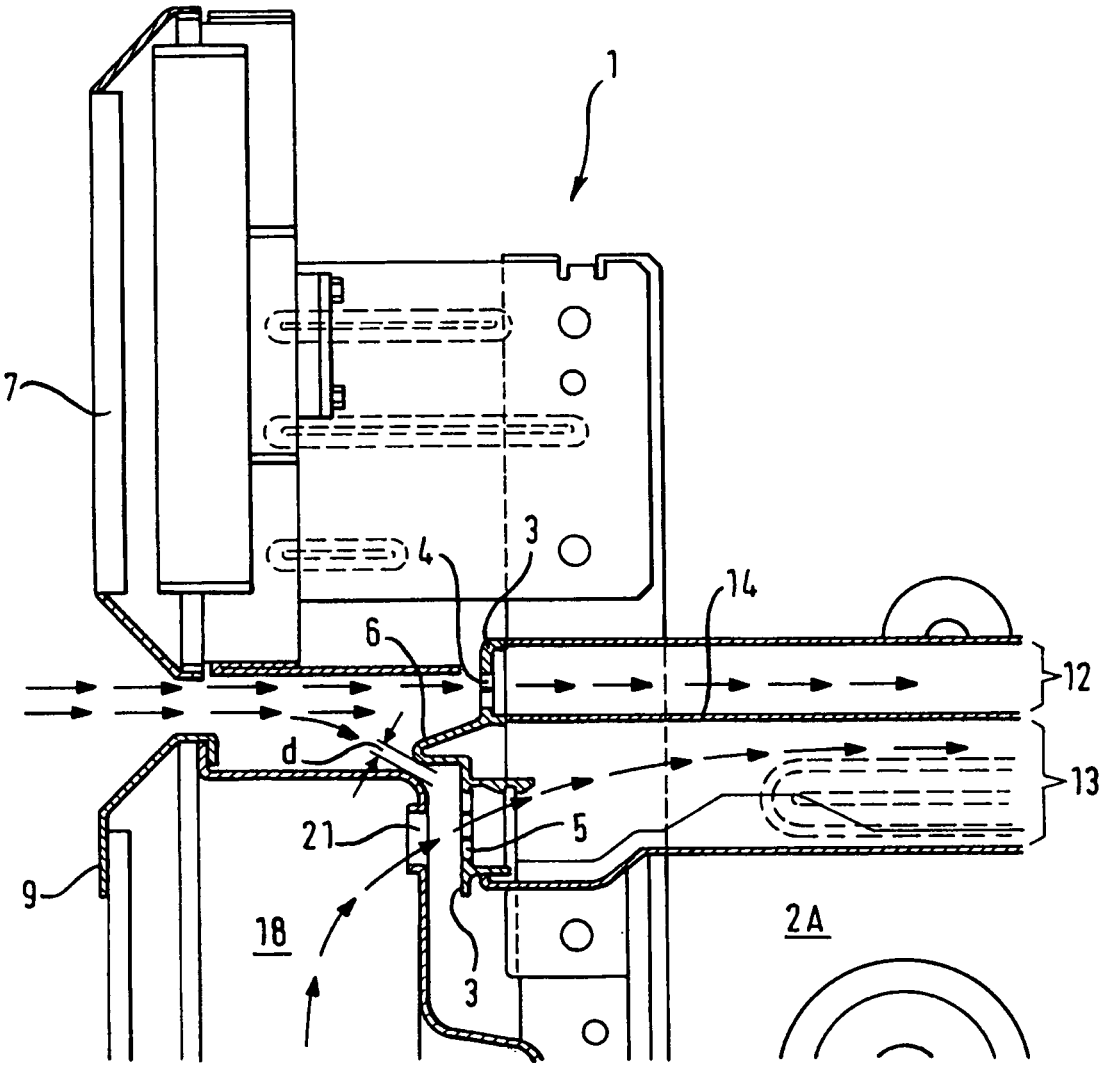
FIG. 4 shows a cross-sectional view of a further segment in detail of the oven shown in FIG. 2 in the area of the ventilation panel.

FIG. 4 shows a different section of the area around the ventilation panel 3. Here the gap d between the projection 6 and the oven door 9 via which fresh air is mixed for cooling of the stream of air sucked out of the door 9 is indicated. Through the embodiment or arrangement of the projection 6 relative to the door, the gap width d can be set such that the amount of fresh air sucked out of the fresh air duct 20 is small enough to avoid significant reduction of the suction power from the door ventilation duct and simultaneously achieve adequate cooling of the air. Separation of the air stream or ventilation controlled by means of slot size can thus be guaranteed.

Thanks to the form of embodiment shown in the exemplary embodiment it is possible to ventilate the subsidiary ventilation ducts 12, 13 to a very large extent separately from each other. Without the dividing wall 6, fresh air would also crucially be sucked from outside into the second, lower subsidiary ventilation duct 13, and the ventilation of the door 9 would thus become uncontrollably weaker. The separation of the ventilation levels is thus decisively achieved through the design of the ventilation panel. Maximum door ventilation can be set up, as it is possible to prevent significant quantities of fresh air reaching the lower row of slots (below the shaped projection), and reducing the door ventilation power. The streams of air can be controlled via the gap size(s). Direction of the fresh air into the first, upper subsidiary air inlet aperture 4 (here in the form of an upper row of slots) is improved by the ramp-like contour of the top of the shaped projection.

LIST OF REFERENCE NUMBERS

1 Oven
2 Housing
2A Upper housing enclosure
2B Lower housing enclosure
3 Ventilation panel
4 First subsidiary air inlet aperture
5 Second subsidiary air inlet aperture
6 Dividing wall
7 Switch panel
8 Oven muffle
9 Oven door
10 Cooking compartment
11 Housing ventilation duct
12 First subsidiary ventilation duct
13 Second subsidiary ventilation duct
14 Carrier plate
15 Electrical and/or electronic components
16 Radial flow fan
17 Exhaust aperture
18 Door ventilation duct
19 Oven door air inlet aperture
20 Fresh air duct
21 Oven door air outlet aperture
22 Class pane
23 Seal

The invention claimed is:

1. A ventilation panel for a ventilation system of an oven having a main air inlet aperture defining an air entry area for the entry of fresh air from outside the oven into the ventilation system, the ventilation panel comprising:

a first subsidiary air inlet aperture formed in the ventilation panel, the first subsidiary air inlet aperture being adapted to allow a first portion of the fresh air to enter a first subsidiary ventilation duct through the first subsidiary air inlet aperture;

a second subsidiary air inlet aperture formed in the ventilation panel, the second subsidiary air inlet aperture being adapted to allow a second portion of the fresh air to enter a second subsidiary ventilation duct through the second subsidiary air inlet aperture; and a dividing wall for at least partially separating the first subsidiary air inlet aperture and the second subsidiary air inlet aperture from each other in the air entry area, wherein the ventilation panel is configured to limit air that enters the second subsidiary ventilation duct to only air that comes from the main air inlet aperture and air that comes from an air duct that runs through a door of the oven.

2. The ventilation panel according to claim 1, wherein the dividing wall is formed as a projection formed integrally with the ventilation panel.

3. The ventilation panel according to claim 2, wherein the projection is adapted to be located in proximity to a door of the oven when the door is in a closed position such that the projection controls what part of the fresh air is the first portion of the fresh air and what part of the fresh air is the second portion of the fresh air.

4. An oven comprising:

a muffle;

at least one housing ventilation duct which directs fresh air from outside the oven at least partially around the muffle, the housing ventilation duct including a first subsidiary ventilation duct, a second subsidiary ventilation duct, and a ventilation panel for directing the fresh air to both the first subsidiary ventilation duct and the second subsidiary ventilation duct;

an oven door for closing an access opening to the muffle and being movable between an open position and a closed position;

a door ventilation duct for directing air at least partially through the oven door toward the ventilation panel; and a door air outlet aperture formed in the door ventilation duct, the door air outlet aperture being disposed in spaced opposition to at least a portion of the second subsidiary ventilation duct when the oven door is in the closed position, wherein the ventilation panel included in the at least one housing ventilation duct includes a first subsidiary air inlet aperture in fluid communication with the first subsidiary ventilation duct, a second subsidiary air inlet aperture in fluid communication with the second subsidiary ventilation duct, and a dividing wall for at least partially separating the first subsidiary air inlet aperture and the second subsidiary air inlet aperture in an air entry area, and with the oven door in the closed position, air from inside the muffle is prevented from entering the second subsidiary ventilation duct.

5. The oven according to claim 4, further comprising a seal between the door and the muffle, the seal preventing air from inside the muffle entering the second subsidiary ventilation duct when the oven door is in the closed position.

6. The oven according to claim 5, wherein the first subsidiary ventilation duct runs parallel to at least a portion of the second subsidiary ventilation duct.

7. The oven according to claim 6, wherein the second subsidiary ventilation duct has a length, and the first subsidiary ventilation duct runs parallel to the second subsidiary ventilation duct over most of the length of the second subsidiary ventilation duct.

8. The oven according to claim 5, wherein the first subsidiary air inlet includes a width dimension, the second subsidiary air inlet includes a width dimension and the dividing wall separates the first subsidiary air inlet and the second subsidiary air inlet over the extent of the width of the first subsidiary air inlet and the width of the second subsidiary air inlet.

9. The oven according to claim 5, wherein the dividing wall is formed as a projection formed integrally with the ventilation panel.

10. The oven according to claim 9, wherein the projection is cross-sectionally chamfered thereby forming a ramp on a side of the projection facing the first subsidiary air inlet aperture and a neck portion of the projection is disposed closely adjacent the first subsidiary air inlet aperture.

11. The oven according to claim 9 wherein the projection is cross-sectionally chamfered thereby forming a ramp on a side of the projection facing the first subsidiary air inlet aperture.

12. The oven according to claim 9, wherein a neck portion of the projection is disposed closely adjacent the first subsidiary air inlet aperture.

13. The oven according to claim 5, wherein the dividing wall forms a gap between the oven door and the second subsidiary air inlet aperture when the oven door is in the closed position.

14. The oven according to claim 5, wherein the second subsidiary air duct extends along the muffle, and the first subsidiary air duct is configured to accommodate at least one of electrical and electronic components, with the first subsidiary air duct being separated from the muffle.

15. The oven according to claim 4, wherein the air directed to the second subsidiary air inlet aperture comes only from at least one of the door air outlet aperture or a fresh air duct that is in fluid communication with ambient air outside of the oven.

16. The oven according to claim 15, wherein the air directed to the second subsidiary air inlet aperture comes from both the door air outlet aperture and the fresh air duct.

17. The oven according to claim 16, wherein the dividing wall is formed as a projection formed integrally with the ventilation panel.

18. The oven according to claim 17, wherein the projection is cross-sectionally chamfered thereby forming a ramp on a side of the projection facing the first subsidiary air inlet aperture and a neck portion of the projection is disposed closely adjacent the first subsidiary air inlet aperture.

19. The oven according to claim 17 wherein the projection is cross-sectionally chamfered thereby forming a ramp on a side of the projection facing the first subsidiary air inlet aperture.

20. The oven according to claim 17, wherein a neck portion of the projection is disposed closely adjacent the first subsidiary air inlet aperture.

21. The oven according to claim 16, wherein the dividing wall forms a gap between the oven door and the second subsidiary air inlet aperture when the oven door is in the closed position.

22. The oven according to claim 16, wherein the second subsidiary air duct extends along the muffle, and the first subsidiary air duct is configured to accommodate at least one of electrical and electronic components, with the first subsidiary air duct being separated from the muffle.

23. The oven according to claim 15, wherein the first subsidiary air inlet includes a width dimension, the second subsidiary air inlet includes a width dimension and the dividing wall separates the first subsidiary air inlet and the second subsidiary air inlet over the extent of the width of the first subsidiary air inlet and the width of the second subsidiary air inlet.

24. The oven according to claim 4, wherein the projection is located in proximity to the oven door when the oven door is in the closed position such that the projection controls what part of the fresh air is the first portion of the fresh air and what part of the fresh air is the second portion of the fresh air.

* * * * *